United States Patent [19]

Rumsey

[11] Patent Number: 4,465,361

[45] Date of Patent: Aug. 14, 1984

[54] APPARATUS AND METHOD FOR DEVELOPING ELECTROGRAPHIC SHEETS

[75] Inventor: Stephen C. Rumsey, Fairport, N.Y.

[73] Assignee: Eastman Kodak Company, Rochester, N.Y.

[21] Appl. No.: 439,151

[22] Filed: Nov. 4, 1982

[51] Int. Cl.[3] ..... G03G 15/00

[52] U.S. Cl. ..... 355/14 SH; 271/270; 355/3 DD; 355/3 SH; 355/77; 430/122

[58] Field of Search ..... 355/14 SH, 3 SH, 16, 355/3 R, 77, 3 DD; 430/122, 123; 271/202, 203, 270, 314

[56] References Cited

U.S. PATENT DOCUMENTS

| | | | |
|---|---|---|---|
| 3,342,126 | 9/1967 | Nesin et al. | 101/90 |
| 3,358,637 | 12/1967 | Shearer et al. | 118/7 |
| 3,514,203 | 5/1970 | Zerfahs | 355/10 |
| 3,554,534 | 1/1971 | Grody | 271/216 |
| 3,583,364 | 6/1971 | Buddendeck | 118/637 |
| 3,727,911 | 4/1973 | Vits | 271/195 |
| 3,980,297 | 9/1976 | Bulso et al. | 271/269 |

*Primary Examiner*—Richard L. Moses
*Attorney, Agent, or Firm*—Lawrence P. Kessler

[57] ABSTRACT

Apparatus and method for developing electrostatic charge patterns on discrete electrographic sheets. The trail edge of a sheet and the lead edge of a successive sheet are overlapped to form a shingled train of sheets. The shingled train of sheets is then moved in pattern-developing relation to a developer station where electroscopic marking particles are applied to develop the charge patterns.

11 Claims, 4 Drawing Figures

FIG. 3
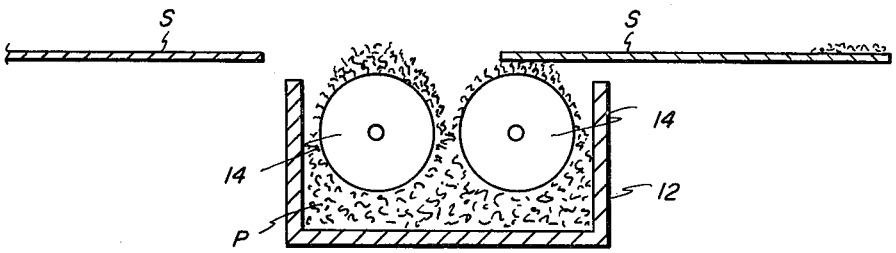
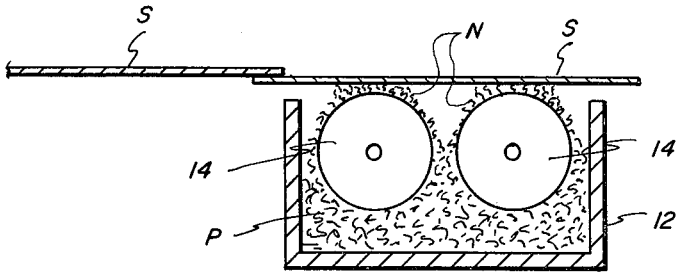
FIG. 4

APPARATUS AND METHOD FOR DEVELOPING ELECTROGRAPHIC SHEETS

BACKGROUND OF THE INVENTION

This invention relates generally to developing electrostatic charge patterns, and more particularly to transporting successive discrete electrographic sheets, respectively carrying electrostatic charge patterns, seriatim into pattern-developing relation with a developer station.

In the copending commonly assigned U.S. Pat. No. 4,436,405 patented Mar. 13, 1984 in the names of Kindt et al, an electrographic copier apparatus is described utilizing a plurality of electrographic film sheets. The copier makes monochrome reproductions, or multicolor reproductions of a multicolor document, by forming electrostatic charge patterns on the film sheets respectively corresponding to the image of the monochrome document or to the related color separation images of the multicolor document. The film sheets are transported seriatim about a track assembly into operative relation with electrographic process stations. In the process stations, the charge patterns are respectively developed with pigmented electroscopic marking particles (for example, black for monochrome reproduction, or complementary primary colors for multicolor reproduction) to form transferable images. In monochrome reproduction, the images are respectively transferred to receiver members and then fixed (fused) to such members to form the reproductions. In making a multicolor reproduction, related transferable images (corresponding) to the color separation images of a multicolor document are transferred seriatim onto a receiver member in accurate superimposed register and then fixed to such member to form the multicolor reproduction of the document.

Development of the electrostatic charge patterns is typically accomplished with magnetic brush developer stations such as shown in U.S. Pat. No. 3,703,395 issued Nov. 21, 1972 in the names of Drexler et al for example. Each developer station includes an applicator having a brush nap of electroscopic marking particles and ferromagnetic carrier particles which is contacted by respective film sheets. The marking particles from the brush naps are attracted to the respective film sheets by the electrostatic charge patterns on such sheets. However, as the film sheets are transported through the developer apparatus, there is a tendency for the film sheets to plow through the brush naps resulting in the undesirable depositing of marking and carrier particles on the back side of the sheets.

SUMMARY OF THE INVENTION

This invention is directed to apparatus and method for developing electrostatic charge patterns on discrete electrographic film sheets. The trail edge of a sheet and the lead edge of a successive sheet are overlapped to form a shingled train of sheets. The shingled train of sheets is then moved in pattern-developing relation to a developer station where electroscopic marking particles are applied to develop the charge patterns.

BRIEF DESCRIPTION OF THE DRAWINGS

In the detailed description of the preferred embodiment of the invention presented below, reference is made to the accompanying drawings, in which:

FIG. 3 is a schematic side elevational view, in cross-section, of a magnetic brush developer station showing the relation of film sheets to such station without the film sheet transport apparatus of this invention; and FIG. 4 is a schematic side elevational view, in cross-section, of a magnetic brush developer station showing the relation of film sheets to such station with the film sheet transport apparatus of this invention.

DESCRIPTION OF THE PREFERRED EMBODIMENT

Figure 1:
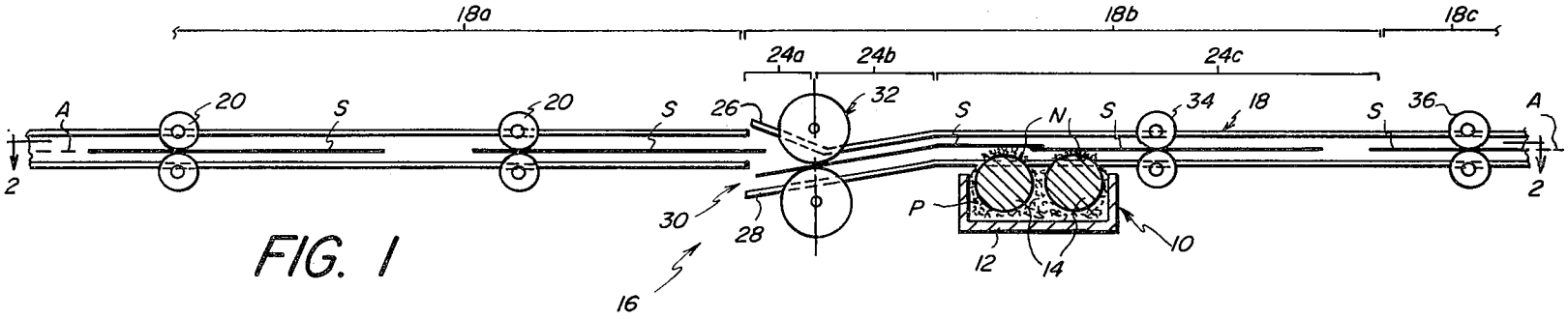
FIG. 1 is a side elevational view, in cross-section, of a magnetic brush developer station including film sheet transport apparatus according to this invention.

Referring now to the drawings, in FIG. 1 a typical magnetic brush developer station 10, such as particularly described in U.S. Pat. No. 3,703,395, is shown for use in a sheet film electrographic copier described in the aforementioned U.S. Pat. No. 4,436,405. Such copier employs four developer stations containing four different color marking particles respectively. Since the stations per se are of identical construction, only one such station (and its associated film sheet transport apparatus) is described hereinbelow. Of course this invention is also suitable for use with a monochrome copier having only one developer station. Moreover, this invention can also be used with copiers utilizing magnetic brush development in other processes such as non-transfer xerography for example where receiver sheets are directly developed.

Figure 2:
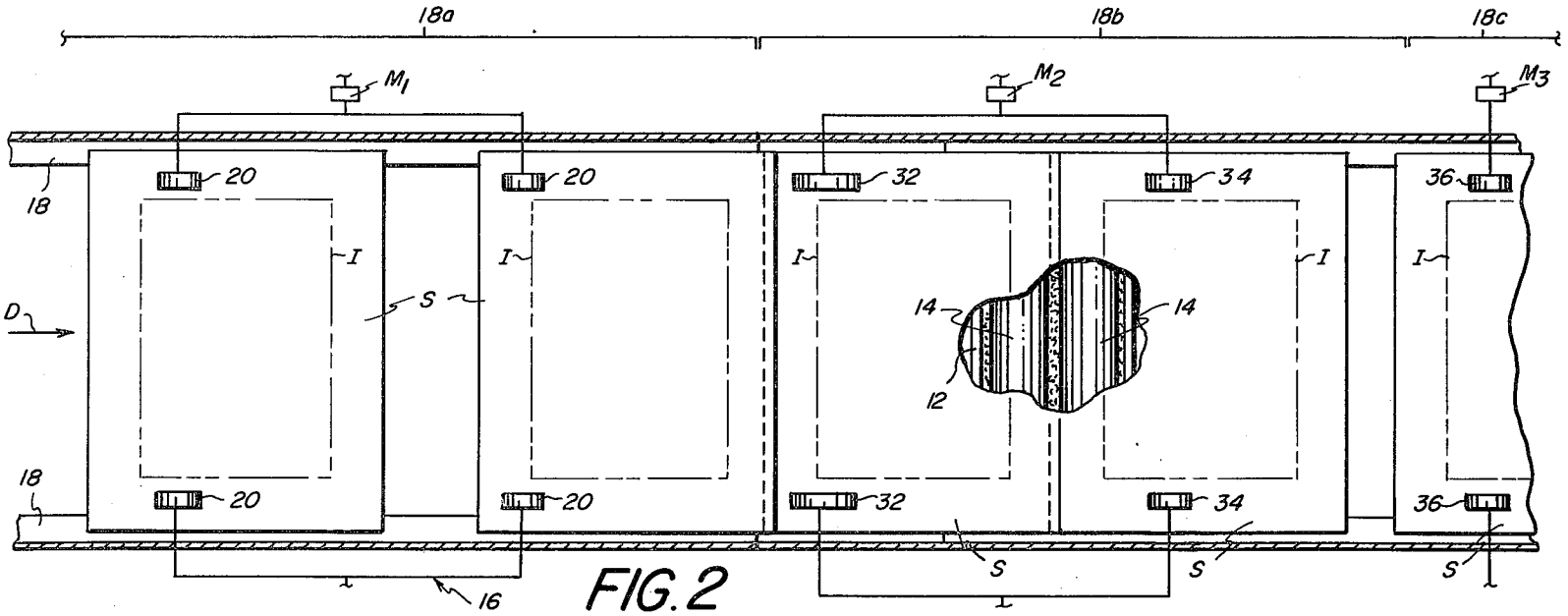
FIG. 2 is a top plan view, on a reduced scale, of the apparatus of FIG. 1 taken along lines 2—2 of FIG. 1.

The developer station 10 includes a housing 12 forming a reservoir for pigmented electroscopic marking particles P, such as disclosed in U.S. Pat. No. 3,893,935 issued July 8, 1975 in the names of Jadwin et al for example, and ferromagnetic carrier particles. Of course, marking particles exhibiting both colorant and magnetic properties (referred to as single component developers) are also suitable for use with this invention. A plurality of applicator rollers 14 produce a magnetic field to establish a brush nap N of marking particles (with or without carrier particles) extending from such rollers in bristle-like fashion. A transport apparatus 16 is associated with the housing 12 to guide electrostatic charge pattern bearing film sheets S into pattern-developing relation with the brush nap N. The film sheets S (see FIG. 2) are discrete rectangular sheets of insulative polyester film having a conductive layer and a photoconductive material layer such as shown, for example, in U.S. Pat. No. 3,615,414 issued Oct. 26, 1971 in the name of Light. Areas I of the sheets are exposed by light images of information to be reproduced to form in such areas corresponding electrostatic charge patterns to be developed by the marking particles.

The transport apparatus 16 includes a pair of parallel tracks 18 defining a film sheet travel path. The tracks are spaced apart a distance substantially equal to the dimension of the film sheet measured between opposed marginal edges disposed in the direction of travel of the film sheets in the path (designated by arrow D in FIG. 2) The tracks have three principle sections designated **18*a*, 18*b*, and 18*c* disposed in the vicinity of the developer station 10 and lying substantially in a plane A intercepting the brush nap N (see FIG. 1). Section 18*a*, upstream of the developer station, defines an entrance section in which film sheets are guided seriatim toward the housing 12 in the plane A. Pairs of transport rollers 20, associated with the section 18***a*, form respective nips at the plane A. The roller pairs 20 are driven by a motor $M_1$, for example, at a first angular velocity to transport the film sheets engaging such rollers along the travel path toward the housing 12 at a first linear speed.

Track section 18*b*, in juxtaposition with the developer station 10, guides the film sheets traveling in the plane A seriatim into pattern-developing contact with the brush nap N. Section 18*b* is, in turn, divided into three portions 24*a*, 24*b* and 24*c* (see FIG. 1). Portion 24*a* has runs 26 and 28 substantially forming a "V". The opening 30 of the "V" is located adjacent to the terminous of section 18*a*. The upper run 26 is directed at an angle to the plane A, extending from above the plane to below the plane in the direction of sheet travel to present an elevational discontinuity in the track section 18*b*. Portion 24*b* is connected to apex of the "V" of the portion 24*a* and is directed at an angle to the plane A, extending from below the plane to the intersection with the plane. Portion 24*c* is connected to portion 24*b* at one end and section 18*c* at the other.

Pairs of transport rollers 32 and 34 are associated with the section 18*b*. Roller pairs 32 form respective nips along a line through the connection of portion 24*a* and 24*b* parallel to the plane A and perpendicular to the direction of sheet travel. Roller pairs 34 form respective nips at the plane A. The roller pairs 32 and 34 are driven by a motor $M_2$, for example, at an angular velocity to transport the film sheets engaging such rollers along the travel path at a linear speed less than the first linear speed. The adjacent sets of roller pairs 20 and 32 are spaced apart a distance slightly greater than the dimension of a film sheet measured in the direction of sheet travel. Sheet inertia moves the sheets leaving transport engagement with one roller pair into engagement with the adjacent roller pair. Thus any sheet is being actively transported by only one of the adjacent sets of roller pairs at a particular time to prevent such sheet from being subjected to different transport drive forces.

Section 18*c*, downstream of the developer station 10, defines an exit section in which the film sheets are guided seriatim away from the housing 12 in the plane A. Pairs of transport rollers 36, associated with the section 18*c*, form respective nips at the plane A. The roller pairs 36 are driven by a motor $M_3$, for example, at an angular velocity to transport the film sheets engaging such rollers along the travel path away from the housing 12 at a linear speed greater than the second linear speed, such as substantially equal to the first linear speed. Adjacent sets of roller pairs 34 and 36 are also spaced apart a distance slightly greater than the dimension of a film sheet in the direction of travel to prevent a sheet from being subjected to different transport drive forces.

With the described transport apparatus 16, a film sheet transported through section 18*a* at a first linear speed by roller pairs 20 enters the opening 30 and the lead edge contacts run 26 of portion 24*a* of the track section 18*b*. The elevational discontinuity provided by track section 18*b* deflects such lead edge below the plane A and directs the sheet into the nip of rollers 32. When such sheet enters the nip of rollers 32, the transport speed of such sheet is reduced to the second linear speed. Portions 24*b* and 24*c* then guide the sheet into charge pattern-developing relation with the brush nap N of the developer station 10 to develop an electrostatic charge pattern on such sheet with marking particles from the nap.

The lead edge of a subsequent film sheet, transported through the section 18*a*, arrives at the section 18*b* before the trail edge of the previous film sheet leaves portion 24*a* of section 18*b* (see FIG. 1). Due to the elevational difference between the lead edge of the subsequent sheet and the trail edge of the previous sheet resulting from the discontinuity provided by track section 18*a*, such lead edge overlaps such trail edge as it is deflected prior to entering the nip of rollers 32. When such subsequent sheet enters the nip of roller 32, its transport speed is reduced to the second linear speed and its trail edge can be similarly overlapped with the lead edge of a following sheet. The described overlapping is repeated for any number of sheets transported by apparatus 16 to form a shingled train of the film sheets for transport of such train through portion 24*b* and 24*c* of the section 18*b*. The amount of overlap is selected to fall outside the image areas I of the sheets by setting the spacing of adjacent sheets transported in the section 18*a* at a predetermined dimension in the direction of travel and preselecting the difference between the first and second linear transport speeds for example.

If the film sheets were transported in sequentially spaced relation to the developer station 10 (as schematically shown in FIG. 3) without the transport mechanism 16 of this invention, the lead edge of each sheet would plow through the brush nap N. Such plowing action would undesirably deposit marking particles (and carrier particles if present in the brush nap) on the back side of the sheets. However, because the film sheets are transported in the shingled train in pattern-developing relation to the developer station 10 by the transport apparatus 16, lead edge of each film sheet is shielded by the trail edge of the previous sheet from the brush nap N (as schematically shown in FIG. 4). Thus, the sheets do not plow through the brush nap and particle deposit on the back sides is prevented.

After the charge pattern on a film sheet is developed, such sheet is transported from section 18*b* into section 18*c*. As a sheet enters section 18*c*, the transport speed of such sheet is accelerated to the first linear speed to move forward relative to its following sheet (traveling at the lower linear speed) in the sheet train. The sheets are then transported seriatim in a spaced train away from the developer station 10 toward a downstream location. The last sheet to be developed in a reproduction run is overlapped by a sheet devoid of an electrostatic charge pattern (dummy sheet) in the manner described above. When the last developed sheet is transported into section 18*c*, drive for the rollers 32 and 34 is interrupted, such as by a suitable control responsive to sheet location in the transport apparatus, to leave the dummy sheet in the section 18*b* of the transport apparatus. Accordingly, when the first sheet of the next train of sheets (reproduction run) is transported by apparatus 16 into section 18*b* to be developed, such sheet overlaps the dummy sheet to form a shingled train of sheets in the manner described above. The drive for rollers 32 and 34 is then activated to transport such shingled train into pattern-developing relation with the brush nap, with the lead edge of such first sheet being shielded from the brush nap by such dummy sheet.

The invention has been described in detail with particular reference to a preferred embodiment thereof, but it will be understood that variations and modifications can be effected within the spirit and scope of the invention as described hereinabove and as defined in the appended claims.

We claim:

1. In apparatus for developing electrostatic charge patterns on discrete electrographic sheets moving seriatim along a path in pattern-developing relation to a developer station having electroscopic marking particles, the improvement comprising:

means for overlapping the trail edge of a sheet and the lead edge of a successive sheet to form a shingled train of sheets; and means for moving the shingled train of sheets in pattern-developing relation to the marking particles to apply such particles to the charge patterns.

2. The invention of claim 1 wherein said overlapping means comprises means for transporting sheets seriatim to the development station at a speed which is greater than that at which the shingled train of sheets is moved.

3. The invention of claim 2 wherein said moving means includes means for deflecting the trail edge of a sheet to accommodate the lead edge of a successive sheet in overlapping relation to such trail edge.

4. In apparatus for developing electrostatic charge patterns on discrete electrographic film sheets moving seriatim along a path into pattern-developing relation to a magnetic brush developer station having a brush nap of electroscopic marking particles, the improvement comprising:

first transport means for moving discrete sheets along such path toward said developer station at a first transport speed; and second transport means, adapted to receive such sheets from said first transport means, for moving such sheets along such path in pattern-developing relation with the brush nap of said developer station at a second transport speed less than said first transport speed, said second transport means having means for deflecting the trail edge of a transported sheet to accommodate the lead edge of a successive sheet transported by said first transport means in overlapping relation to such trail edge to form a shingled train of sheets, whereby such trail edge shields such lead edge from the brush nap.

5. The invention of claim 4 wherein said first and second transport means comprise spaced parallel tracks for engaging opposed marginal edges of said sheets to guide such sheets along said path in a plane; and wherein said deflecting means of said second transport means comprises an elevational discontinuity in said tracks upstream of said developer station, which displaces the trail edge of a sheet relative to such plane.

6. The invention of claim 4 wherein said first and second transport means comprise rotatable rollers for drivingly engaging such sheets to move such sheets along said path, and means for rotating such rollers of said first transport means at one peripheral speed and for rotating such rollers of said second transport means at a peripheral speed less than the peripheral speed of said rollers of said first transport means.

7. The invention of claim 6 wherein the last sheet in the shingled train of sheets is devoid of an electrostatic charge pattern, and said roller rotating means includes control means for interrupting rotation of said rollers of said second transport means to leave such last sheet in pattern-developing relation with the brush nap and in position where the trail edge of such last sheet and the lead edge of the first sheet in the next train of sheets are overlapped.

8. The invention of claim 7 wherein said control means restarts rotation of said rollers of said second transport means after the trail edge of such last sheet and the lead edge of such first sheet in the next train of sheets are overlapped to move such next train of sheets in pattern-developing relation with the brush nap of said developer station.

9. Method of developing, seriatim, electrostatic charge patterns on discrete electrographic sheets with electroscopic marking particles, comprising the steps of:

overlapping the trail edges of discrete sheets and the lead edges of successive sheets respectively to form a shingled train of sheets; and moving the shingled train of sheets in pattern-developing relation to the marking particles to apply such particles to the charge patterns.

10. The invention of claim 9 wherein in said moving step the last sheet in the shingled train of sheets, devoid of an electrostatic charge pattern, is left in pattern-developing relation with such marking particles and in position where the trail edge of such last sheet and the lead edge of the first sheet in the next train of sheets are overlapped.

11. The invention of claim 10 wherein in said moving step, after the trail edge of such last sheet and such lead edge of the first sheet in the next train of sheets are overlapped, such next train of sheets is moved in pattern-developing relation to the marking particles.

* * * * *